United States Patent [19]

Coggins

[11] 4,363,072

[45] Dec. 7, 1982

[54] ION EMITTER-INDICATOR

[75] Inventor: George G. Coggins, Redwood City, Calif.

[73] Assignee: ZeCo, Incorporated, San Jose, Calif.

[21] Appl. No.: 170,844

[22] Filed: Jul. 22, 1980

[51] Int. Cl.[3] ..... H01T 19/04

[52] U.S. Cl. ..... 361/231; 250/324; 310/308

[58] Field of Search ..... 361/212, 213, 229, 230, 361/231, 233; 310/308, 309; 335/302; 248/206 A; 403/DIG. 1; 308/10; 417/48, 49; 315/111.8, 111.9, 357; 313/359; 250/324, 325, 326

[56] References Cited

U.S. PATENT DOCUMENTS

| | | | |
|---|---|---|---|
| 1,974,483 | 9/1934 | Brown | 310/308 UX |
| 3,195,964 | 7/1965 | Sieurin | 308/10 |
| 3,729,649 | 4/1973 | La Chappelle et al. | 250/326 |
| 3,818,269 | 6/1974 | Stark | 361/231 |
| 3,873,835 | 3/1975 | Ignatjev | 361/230 X |

OTHER PUBLICATIONS

"Li'l TC"-Kaufman, Popular Electronics, Jul. 1964, pp. 33-35.

*Primary Examiner*—Harry E. Moose, Jr.
*Attorney, Agent, or Firm*—Marshall C. Gregory

[57] ABSTRACT

An emitter for ion generators or air ionizers shaped as a fan and provided with a boss which may also act as a socket, so that the emitter may be either rested on a vertical pin or needle or suspended magnetically from a fixture containing a suitable magnet. In either case, application of voltage will produce a corona discharge of electrons from points at the tips of the blades, and the emitter will revolve or spin from reaction to the forces produced by this discharge. In so revolving, it acts as a fan and induces a current of air to help disperse the ions produced.

4 Claims, 5 Drawing Figures

ION EMITTER-INDICATOR

BACKGROUND OF THE INVENTION AND PRIOR ART

This invention relates to ion generators or air ionizers being widely advertised and sold for use in homes and offices. These devices generate negative ions which have the effect of cleansing the air of many particles and creating a more invigorating atmosphere for humans. Enclosed spaces, with or without air conditioning tend to develop a surplus of positive ions, leading to lassitude, irritability and fatigue in persons therein, as well as a surfeit of smoke, haze, and pollution. High mountain air, notably clean and fresh, tends to have a high concentration level of negative ions.

These devices, many of which are small and portable, operate essentially by generating a high potential (on the order of 3,000 volts or more) which is then applied to one or more emitting elements, each of which may be a single needle or point, or a ball of "fuzz" providing many filament ends or some other type of conducting element affording surface discontinuities which will make possible a discharge or corona effect, releasing electrons or negative ions.

Predominantly these small "air energizers", "ionized oxygen generators" or "air ionizers" which are among the advertised designations, produce electrons by corona discharge, the electrons then combining with oxygen or other molecules in the air to produce ions. In U.S. Pat. No. 4,139,879 (1979) to LAWS, a sharp needle type emitter is said to produce a stream of electrically charged air molecules, or ions, propelled into the surrounding air by what is referred to as "the well known 'electric wind' effect". The subject of the patent is not the discharge itself, but the use of a reflector to divert the ion stream while shielding the needle emitter.

Generally those ionizers in wide use tend to produce ionized oxygen, or ozone, predominantly. Since too high a concentration of ozone can have deleterious effects, U.S. Pat. No. 3,873,835 (1975) to IGNATJEV uses carbon emitters to generate $CO_3$- ions which, it is stated therein, are the dominant ions in air at [normal] atmospheric pressure for negative corona. In that invention, these emitter surfaces (either sharp points or a braided surface) are mounted on a powered fan which serves to provide a generated air flow to propagate and disperse the ion flow.

In 1920 U.S. Pat. No. 1,356,484 issued to BOLTAS for a motor driven rotating discharge wheel of pointed rod emitters, mounted on a tower, suitably charged, for the purpose as described of discharging current into the air (using the earth as a ground plane) for the purpose of making rain.

SUMMARY OF THE INVENTION

The invention described herein is a small rotating emitter, symmetrical about its center of mass, and having blades or arms at the extremities of each of which is at least one sharp point to serve as an emitting source for the discharge of electrons. The emitter is formed by chemical etching from a single piece of 0.010 inch (0.254 mm) stainless steel. While other materials may be used, so long as voltage is conducted to emitter points, stainless provides the sharpest points.

In its simplest form the emitter rests on the point of a pin or needle through which it is supplied with power from an ionizer power supply, A small depression pressed into the center of the emitter's hub acts as a socket to keep it on the pin. Voltage applied through the pin support produces corona discharge of electrons from the sharp points at the extremities of each blade. The electrons combine with gas molecules in the air, creating the "electric wind", reaction to which causes the emitter to revolve or spin. Suitable shaping and twisting of the blades makes of the emitter a small fan requiring no external power to induce airflow.

In another, and preferred, configuration, the emitter, here of stainless or magnetic material, is suspended by magnetic attraction from a small magnet, on which has been electroformed a layer of about 0.010 inches (0.254 mm) of copper. The layer of copper serves not only to provide for better conductivity to the emitter, but also for less wear from the spinning of the emitter against the magnet. It also reduces the magnetic flux somewhat. The emitter suspended by magnetic attraction, will still spin rapidly, producing the same effects as described above for an emitter resting on a pin.

DESCRIPTION OF THE PREFERRED EMBODIMENT

Figure 1:
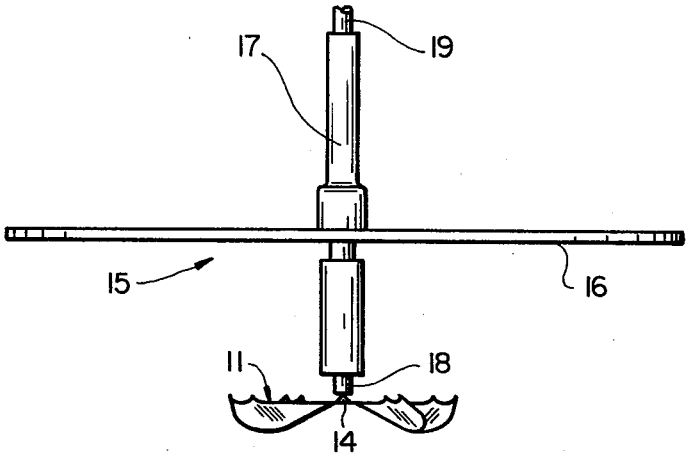
FIG. 1 shows a side view of the preferred embodiment, with the emitter fan suspended by magnetic attraction, and showing the twist or camber of the blades.

As shown in FIG. 1, an emitter-indicator 11 is shown suspended from a ceiling mounting fixture 15. This mounting fixture, which could be hung from other surfaces as well as ceilings, comprises a flat reflector surface 16, here a circular disk of clear plastic, through which passes a housing 17, essentially two plastic tubes telescopically and fixedly attached through disk 16. In the lower end of housing 17 is a cylindrical magnet 18. High voltage power supply cable 19 supplies high potential from the ionizer power supply through housing 17 to magnet 18.

The emitter 11 is shown here with four blades, although any reasonable number providing symmetry and balance could be used. Each blade or arm 12 has at its outer end sharp points 13, there being here two on the trailing edge of each blade. Each blade also has introduced into it a uniform twist or camber as shown (FIGS. 1 & 4), to provide for effect as a fan in inducing a current of air as it rotates.

Figure 2:
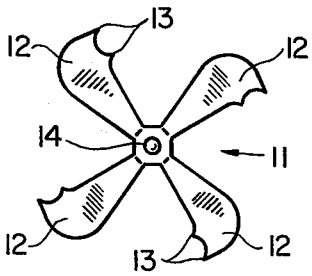
FIG. 2 is a plan view of the emitter-indicator.
Figure 3A:
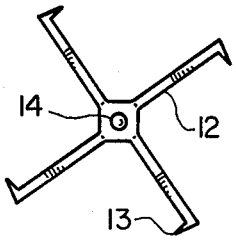
FIGS. 3A,3B show other illustrative shapes for the emitter.
Figure 3B:
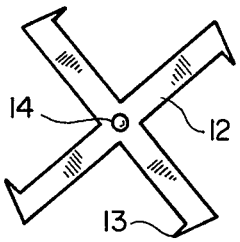

At the center of mass and symmetry of the emitter, a small indentation is pressed into the hub, more or less hemispherical in shape, or in the shape of the frustrum of a cone. This indentation produces on the one side a concavity, which may act as a small hub or socket for resting the emitter on the head of a pin protruding from an ionizer. On the other side the effect is that of a boss or protruberance, with a flattened or rounded upper part. This boss (or, in corollary, indentation) is shown (14) in FIGS. 1, 2 and 4.

For the preferred embodiment, wherein emitter 11 is to be suspended magnetically, enough magnetic attraction is possible through the boss to hold the very lightweight emitter-spinner suspended, while still allowing for its rotation in reaction to the force generated from the emission of electrons. The simplest form of the emitter, of thin stainless only a little over two inches in diameter, is quite light and a number of small, readily available magnets will work to suspend it. A simple means of attaining better magnetic retention is to place a small steel ball (not shown) in the hollow side of the socket. The emitter may be made considerably larger, in which case a larger magnet (or stronger) will be needed. Larger emitters or magnets may require an increase in voltage. While a potential of 3,000 volts may produce corona discharge, up to 15,000 volts is obtainable in standard ionizers, and either form of the emitter fan described herein, whether resting on a pin or magnetically suspended, will function considerably more efficiently at the higher potentials, to ensure both emission and spinning to act as an emitter-indicator. While it is desirable to copper-plate the magnet for better conductivity and reduced friction from the contact of dissimilar metals, it is not mandatory.

Figure 4:
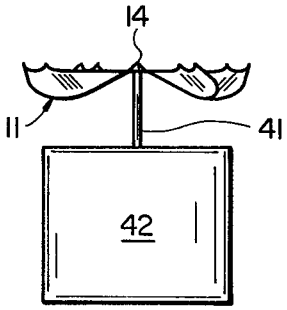
FIG. 4 shows the emitter in its simplest form, resting on a pin directly atop an ionizer power supply.

The same emitter-indicator may rest on a vertical pin or needle which is supplied with power (3,000 volts or more) from an ionizer power supply. The simplest form is shown in FIG. 4, where emitter 11 rests on pin 41 protruding directly from ionizer 42. It may be desirable, however, to lead the power by a high voltage cable (as in the preferred embodiment) to a pin or needle remote from the power supply itself.

With the camber or twist imparted to the blades as shown, the emitter becomes, as described, a small fan requiring no power to act as such, and induces a current of air to help propagate the ions produced. As shown, the current of air will be in an upwards direction whether the emitter fan rests on a pin support or is suspended magnetically as shown in FIG. 1. In the latter case, reflector surface 16 will deflect and distribute the airflow.

While the simplest and preferred embodiments of the invention have been described, it should be clear that the specific sizes given are not a limitation, and that it is specifically within the intent of the disclosure and claims that the emitter fan may be made of considerably larger dimensions for other application than small portable ionizers, and that other materials may be used in its manufacture, including non-metallic ones providing for wires or other means conducting potential to the emitter points. Other minor variations are considered to be within the scope of that which is claimed.

I claim as my invention:

1. An emitter for negative ion generators, of light, thin, electrically conductive material, adapted with a center hub or indentation to rest upon a pin supplying said emitter with electric potential from an ionizer power supply, said emitter being in a symmetrically balanced form disposing a plurality of projecting members, each of which said projecting members provides on one edge at or near its end at least one sharp point, which said sharp points act as discharge elements for the emission of electrons and are so disposed as to cooperate in cumulating the effect of the forces produced from the reaction of said emitted electrons with the surrounding air molecules to produce ions, said reactive forces causing said emitter to revolve; further providing said projecting members are so shaped as to act as a fan and induce airflow from the revolution of said emitter to aid in propagation of the ions produced from the emission of said electrons.

2. An emitter for negative ion generators, of light, thin, electrically conductive material which also is capable of being attracted by magnetic force, said emitter being in a symmetrically balanced form disposing a plurality of projecting members, each of which said projecting members provides on one edge at or near its end at least one sharp point, which said sharp points act as discharge elements for the emission of electrons and are so disposed as to cooperate in cumulating the effect of the forces produced from the reaction of said emitted electrons with the surrounding air molecules to produce ions, said reactive forces causing said emitter to revolve, further providing that at the center of mass of said emitter a symmetrical and smooth convex protuberance is formed, which said protuberance is adapted to be placed in contact with the face of a magnet in such a manner that said magnet holds said emitter in magnetic suspension, said emitter hanging from said magnet; in addition providing that said magnet supplies to said emitter electric potential from an ionizer power supply, so that electrons are emitted from the said discharge elements, and the said air-electron reaction produces forces causing the emitter to revolve while magnetically suspended.

3. An emitter for negative ion generators, as described in claim 1 or 2, wherein said symmetrically disposed projecting members provide said sharp points as discharge elements for ion emission symmetrically on a plurality, but less than all, of said projecting members.

4. An emitter as described in claim 2, further providing that the said projecting members are so shaped as to act as a fan and induce airflow from the revolution of said emitter to aid in the propagation of the ions produced from said emission of electrons.

* * * * *